US005875562A

United States Patent [19]

Fogarty

[11] Patent Number: 5,875,562

[45] Date of Patent: Mar. 2, 1999

[54] HAND-HELD HAIR DRYER WITH VIBRATION AND NOISE CONTROL

[76] Inventor: Shaun P. Fogarty, 529 Broadway Ave., Santa Cruz, Calif. 95062

[21] Appl. No.: 878,055

[22] Filed: Jun. 18, 1997

[51] Int. Cl.[6] ..... A45D 20/00

[52] U.S. Cl. ..... 34/97; 392/380; 392/385

[58] Field of Search ..... 34/97, 96, 99, 34/100, 101; 392/379, 380, 384, 385

[56] References Cited

U.S. PATENT DOCUMENTS

| | | | |
|---|---|---|---|
| 1,564,896 | 12/1925 | Rinker et al. . | |
| 3,426,441 | 2/1969 | Broski . | |
| 4,135,080 | 1/1979 | Wells, Jr. | 34/97 X |
| 4,232,454 | 11/1980 | Springer | 34/97 |

*Primary Examiner*—Henry Bennett
*Assistant Examiner*—Susanne C. Tinker
*Attorney, Agent, or Firm*—Martin L. Stoneman

[57] ABSTRACT

Described is a quiet hand-held hair dryer with configuration and component combinations for making the hair dryer exceptionally quiet and efficient. The hair dryer includes a housing having a lower handle portion and an upper body portion separated by an air-directing wall. A large impeller moves air downward from a large top air inlet and passes it outward through a side air outlet in a hair drying stream. An electric motor is mounted in the handle housing adjacent its bottom and is connected in driving relation with the impeller by a long vertical shaft. The motor is mounted in a rubber casing permitting cooling air flow and minimizing vibration to the housing; and the upper end of the shaft is stabilized by a bearing mounted in a rubber housing for the same purpose. The configuration of the described hair dryer permits high air flow with relatively low motor speeds.

22 Claims, 5 Drawing Sheets

FIG. 1
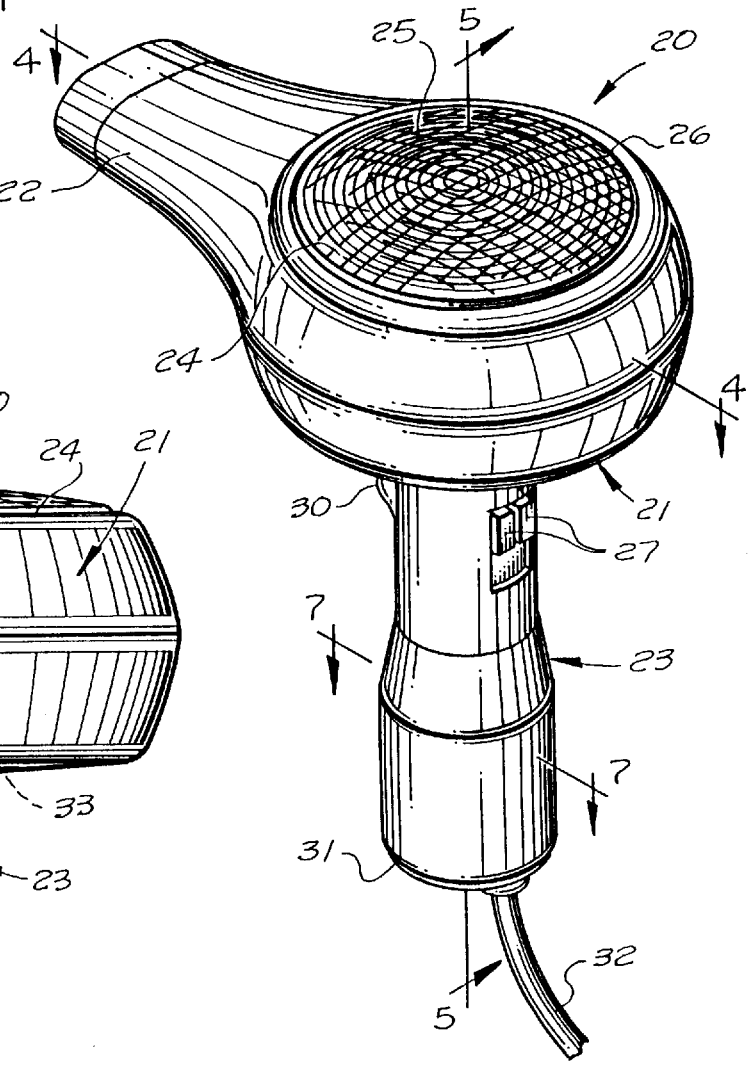
FIG. 2
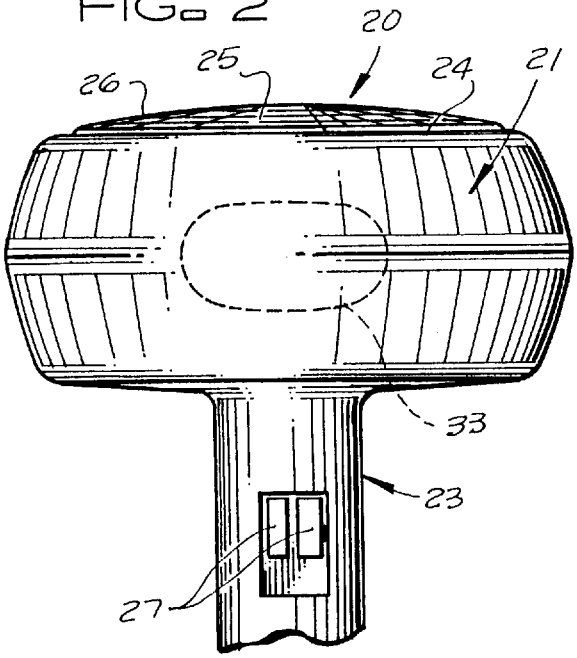
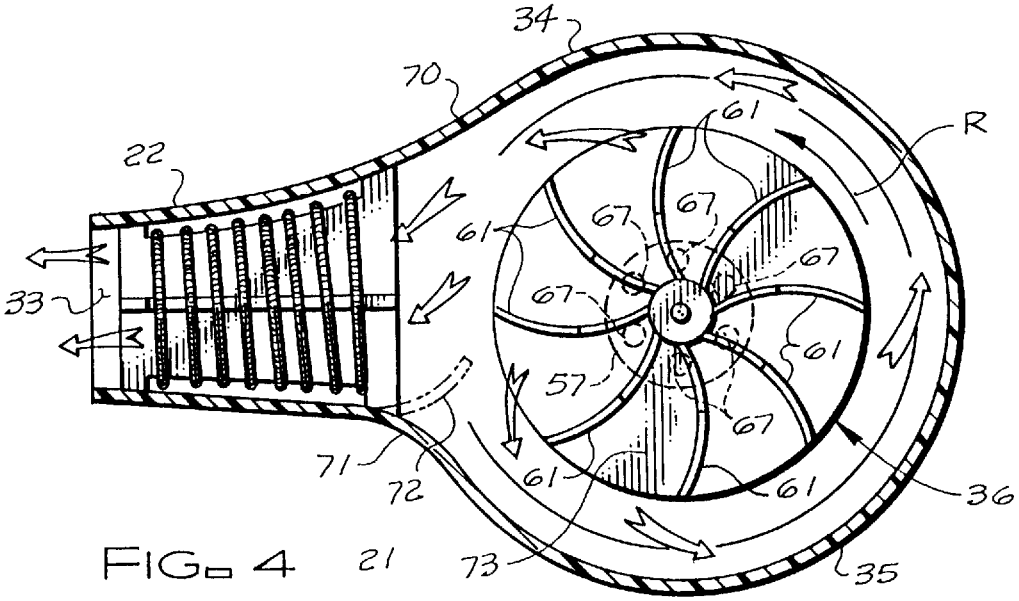
FIG. 4 21

FIG. 5
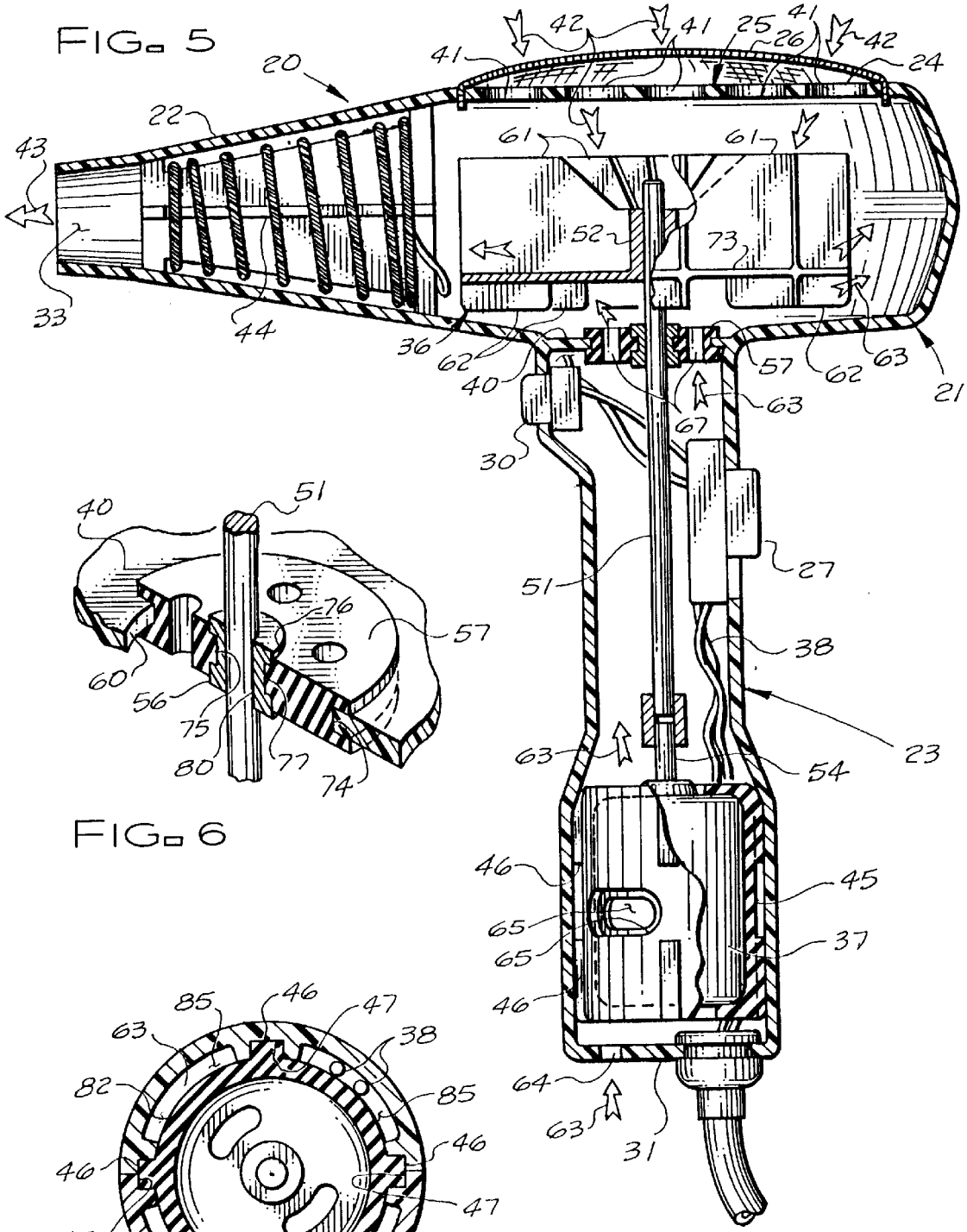
FIG. 6
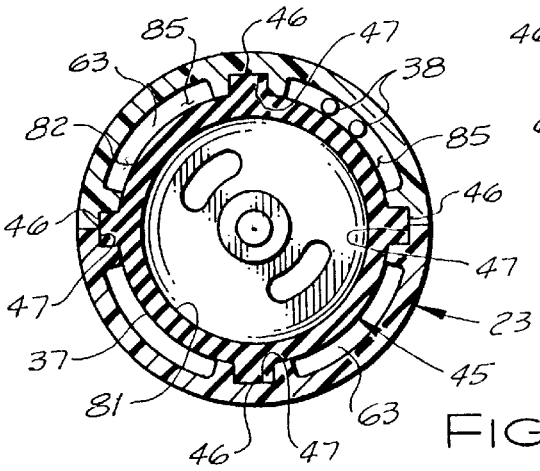
FIG. 7

HAND-HELD HAIR DRYER WITH VIBRATION AND NOISE CONTROL

BACKGROUND OF THE INVENTION

1. Field of the Invention

This invention relates to providing a quiet hand-held hair dryer. More particularly, this invention concerns hair dryer configuration and component combinations for making the hair dryer exceptionally quiet and efficient.

2. Description of the Prior Art

Typically, a portable (hand-held) electric hair dryer has an elongated housing of insulating material which is provided with a handle and has an air-admitting inlet and an air-discharging outlet. A rotary impeller which is driven by an electric motor draws air into the housing by way of the air-admitting inlet and induces a flow of air toward the air-discharging outlet whereby the air stream passes along one or more electric heating elements. Typically, such portable hair dryers emit noise which is both loud and experienced as unpleasant. Some of the reasons for this noise are the following:

1) The typical internal configuration places the electric motor between the impeller and air-discharging outlet. This configuration limits the space available for air passage, necessitating a velocity of air flow at the impeller which is much faster than that experienced at the air-discharging outlet. In order to achieve this faster airflow, the motor must operate at very high revolutions per minute (18,000–20,000). At this high speed, the electric motors emit a sound which is experienced by users as being both loud and irritating.

2) The electric motor is typically pressed into a casing which is integral to the housing and secured with machine screws. As a result, the housing amplifies the vibrations of the motor by converting mechanical energy of the motor to sound energy.

3) The noise emitted by electric motors is typically left undampened, leaving the motor noise an unobstructed passage to the user's ear.

4) The air-admitting inlet, through which much of the high frequency sound escapes, is usually positioned in the back of the hair dryer—which points the high frequency noise emission at salon users, or it is on the side of a hair dryer—which faces the high frequency emission at both salon and home users.

5) The tip speed of the impeller is kept slower than optimal for a given motor speed due to impeller sizes typically measuring only two and a quarter inches across their diameter. Tip speed is also diminished in relation to motor speed by impeller blade designs which equalize the rate of airflow between the inside of an impeller blade and the outside of an impeller blade.

A hair blower design which addresses one or more of the above issues would reduce the noise output of a hand-held portable hair dryer. A hair dryer which successfully addresses all of these issues would substantially reduce the noise output. Inasmuch as hair dryers are appliances in daily use, which can only survive in the marketplace if they can be manufactured at attractive prices in large quantities utilizing the latest mass-production techniques, design improvements must be combined with the aim of achieving the desired improvements with minimal to no additional manufacturing costs. Typically, portable hair dryer patents which have addressed noise output have neglected the above design issues.

OBJECTS OF THE INVENTION

A primary object of the present invention is to fulfill the above-mentioned needs by the provision of a quiet and efficient hand-held hair dryer. A further primary object of the present invention is to provide such a hair dryer which is more ergonomic, inexpensive, and handy, as well as substantially quieter than current models. It is a further object and feature of this invention to reduce the motor rpm without reducing air flow. Another object and feature of this invention is to mount the motor to the housing in such a fashion that the transmission of motor vibration to the housing is reduced. A further object and feature of this invention is to directly dampen the noise emitted from the motor. An additional object and feature of this invention is to isolate the impeller bearing in such a fashion that the transmission of the impeller shaft vibration to the housing is reduced. Another object and feature of this invention is to modify the impeller so that the outside tip of the impeller moves most of the air. Another object and feature of this invention is to provide cooling for the electric motor, and thereby increase its longevity. Other objects and features of this invention will become apparent with reference to the following invention descriptions.

SUMMARY OF THE INVENTION

In a hair dryer configured according to the described invention, noise emission is decreased by roughly half. The increase in air pump efficiency achieves much of this noise reduction by allowing the impeller and thus the motor to spin at much slower revolutions per minute for the same air throughput. Also, for example, the positioning of the motor away from the users' ears, and the use of a resilient elastomeric casing to isolate the motor vibrations and to dampen the motor noise further reduces noise emissions; and the use of an elastomeric mounting to isolate the impeller shaft vibration from the housing still further reduces the amount of noise emitted from a portable hair dryer.

According to a preferred embodiment of the present invention, this invention provides, in a quiet hand-held hair dryer, the combination comprising: a housing having a lower handle portion and an upper body portion forming upper air inlet and air outlet passages for passing air into such housing and for discharging such air in a hair drying stream, such housing having a top and a bottom; separation means for substantially separating such lower handle portion from such upper body portion; air inlet means at such top of such housing, for supplying air to such hair dryer; immediately beneath such air inlet means, rotor means for blowing such air in a hair drying stream; an electric motor, adjacent such bottom of such housing, connected in driving relation with such rotor means; and shaft means, having an upper and a lower end, for connecting such electric motor in driving relation with such rotor means. It also provides such a hair dryer further comprising first resilient means for mounting such electric motor within such lower handle portion in such manner as to minimize sound and vibration in such handle portion; and, further, comprising bearing means for holding such upper end of such shaft means in fixed relation to such housing and second resilient means for mounting such bearing means within such housing in such manner as to minimize sound and vibration in such housing. It further provides such a hair dryer further comprising gap means for providing substantial air space portions between such lower handle portion and such first resilient means. Further, it provides such a hair dryer wherein such first resilient means comprises a resilient rubber-like cylindrical motor boot having an outer surface comprising mounting means, including multiple outward projections, for mounting such electric motor within such lower handle portion; and, further, wherein such first resilient means further comprises, on an inner surface of such lower handle portion, socket means, including multiple inward projections, for holding such motor boot.

Additionally, according to a preferred embodiment thereof, this invention provides such a hair dryer wherein such rotor means comprises a rotor comprising: an upper impeller portion comprising first impeller blades; a lower impeller portion comprising second impeller blades; and a disc-shaped portion separating such upper impeller portion from such lower impeller portion. It also provides such a hair dryer wherein such separation means comprises a lower portion of such passages. It further provides such a hair dryer wherein such lower impeller portion is adjacent and above such separation means, and wherein such hair dryer is constructed and arranged in such manner that, in operation, the relation between such disc-shaped portion and such separation means muffles sound and vibration in such hair dryer. And it also provides such a hair dryer wherein a such upper air inlet passage has at least as great a diameter as the diameter of a greatest sweep of such rotor means. It further provides such a hair dryer wherein such bearing means and such second resilient means comprise a portion of such separation means.

Moreover, according to a preferred embodiment thereof, the present invention provides, in a quiet hand-held hair dryer, the combination comprising: a housing having a lower handle portion and an upper body portion forming upper air inlet and air outlet passages for passing air into such housing and for discharging such air in a hair drying stream, such housing having a top and a bottom; separation means for substantially separating such lower handle portion from such upper body portion; air inlet means at such top of such housing, for supplying air to such hair dryer; air outlet means, at a side of such housing, for directing such hair drying stream in a direction substantially perpendicular to the direction of flow of such air in such air inlet passage for passing air into such housing; immediately beneath such air inlet means, rotor means for blowing such air in a hair drying stream; heating means, in such air outlet passage, for heating such air; an electric motor, adjacent such bottom of such housing, connected in driving relation with such rotor means; shaft means, having an upper and a lower end, for connecting such electric motor in driving relation with such rotor means; first resilient means for mounting such electric motor within such lower handle portion in such manner as to minimize sound and vibration in such handle portion; bearing means for holding such upper end of such shaft means in fixed relation to such housing; and second resilient means for mounting such bearing means within such housing in such manner as to minimize sound and vibration in such housing; wherein a such upper air inlet passage has at least as great a diameter as the diameter of a greatest sweep of such rotor means; and, further, wherein such rotor means has a diameter of at least about 3 inches.

This invention also provides such a hair dryer wherein such separation means comprises a lower portion of such passages; and, further, wherein such rotor means comprises a rotor comprising an upper impeller portion comprising first impeller blades constructed and arranged to blow air from such air inlet passage to such air outlet passage, a lower impeller portion comprising second impeller blades constructed and arranged to blow air from such lower handle portion to such air outlet passage, and a disc-shaped portion separating such upper impeller portion from such lower impeller portion; and, further, wherein such lower impeller portion is adjacent and above such separation means, and wherein such hair dryer is constructed and arranged in such manner that, in operation, the relation between such disc-shaped portion and such separation means muffles sound and vibration in such hair dryer; and, further, wherein such bearing means and such second resilient means comprise a portion of such separation means.

And it provides such a hair dryer wherein such first resilient means comprises a resilient rubber-like cylindrical motor boot having an outer surface comprising mounting means, including multiple outward projections, for mounting such electric motor within such lower handle portion; and, further, wherein such first resilient means further comprises, on an inner surface of such lower handle portion, socket means, including multiple inward projections, for holding such motor boot; and, further, wherein such motor boot comprises cooling means, including at least one transverse hole, for permitting cooling air from outside such motor boot to access such electric motor.

BRIEF DESCRIPTION OF THE DRAWINGS

FIG. 1 is a perspective upper rear quarter view of the preferred embodiment of the quiet hand-held hair dryer.

FIG. 2 is a rear elevation view of the hair dryer.

FIG. 4 is a cross-section plan view of the air chamber.

FIG. 5 is a cross-section side elevation view of the hair dryer.

FIG. 6 is a perspective view of the bearing isolator.

FIG. 7 is a cross-section plan view through the handle in the area of the motor.

DETAILED DESCRIPTION OF A PREFERRED EMBODIMENT AND THE BEST MODE OF PRACTICE

Figure 3:
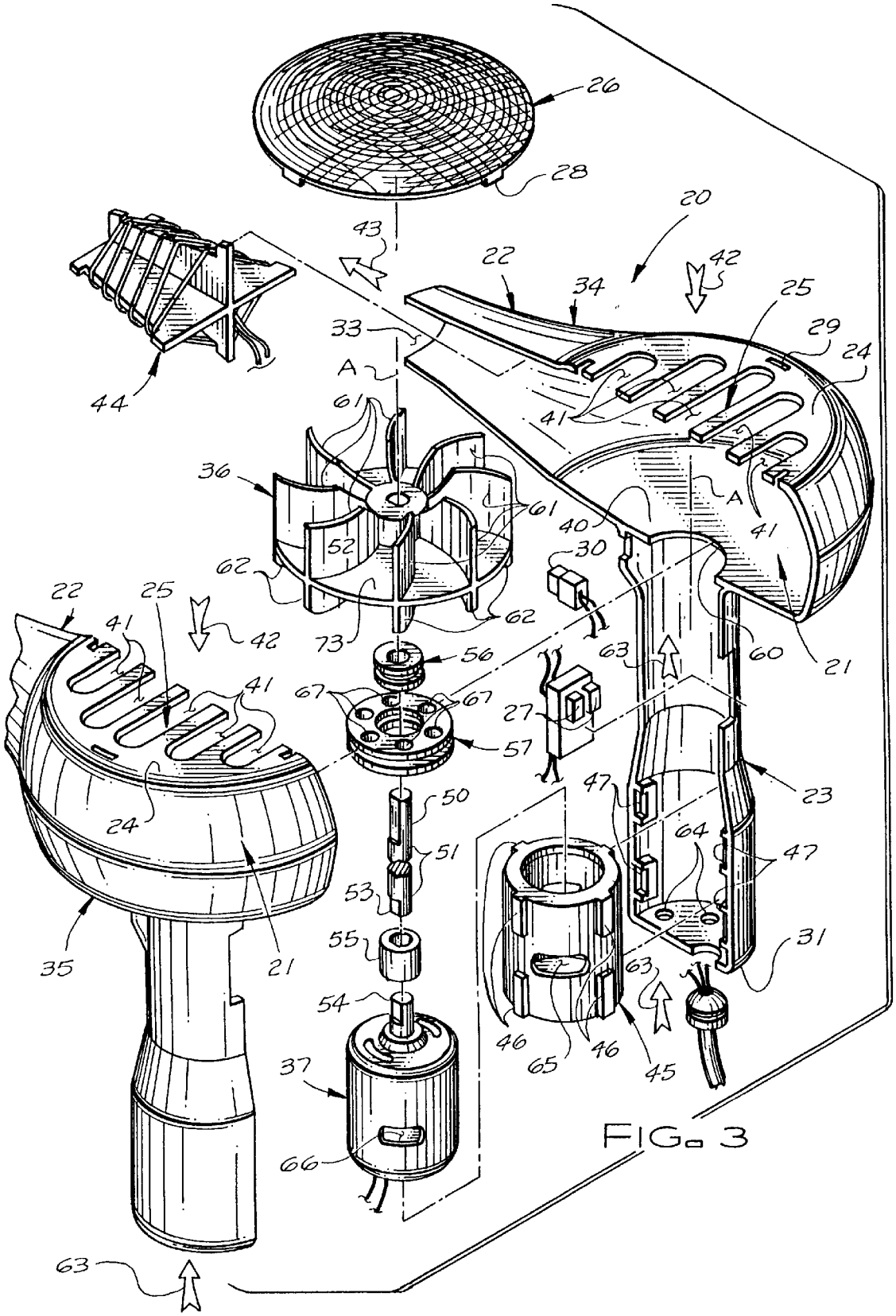
FIG. 3 is an exploded perspective view of the hair dryer.

Illustrated in FIG. 1, in perspective, is a preferred embodiment of the hand-held hair dryer 20 of the present invention. The view shows the upper, rear, and right hand portions of the hair dryer 20. The major portions of the hair dryer 20 consist of a blower housing 21, with a protruding air-discharge end 22, and with the blower housing 21 centrally located above a downwardly extending handle housing portion or handle 23. Almost the entire top surface 24 of the blower housing 21 serves as an air inlet 25 and is covered with an inlet screen 26. These elements embody in this invention a housing having a lower handle portion and an upper body portion forming upper air inlet and air outlet passages for passing air into such housing and for discharging such air in a hair drying stream, such housing having a top and a bottom. Located near the upper end of the handle 23, on the rear facing side, are operator controls consisting of air-flow and heater switches 27, and on the forward facing side (facing the air discharge end 22), there is an optional "cold shot" trigger 30. Extending from the bottom end 31 of handle 23 is the electrical supply cord 32.

FIG. 2 is a rear elevation view of the hair dryer 20, showing the rear side of the blower housing 21 and the upper portion of the handle 23. The air-discharging outlet 33 of the discharge end 22, hidden from view, is shown by dotted line. Air-flow and heater switches 27 are located on handle 23. Blower housing 21, as shown, has a generally circular perimeter (except for discharge end 22) and is quasi-cylindrical in shape (except for discharge end 22), with the center portions of the perimeter extending outward somewhat, as shown; and blower housing 21 is centrally located, as shown, above the downward extending handle 23. Almost the entire top surface 24 (subject, of course, to support requirements) of the blower housing 21 serves as the air inlet 25, embodying herein air inlet means at such top of such housing, for supplying air to such hair dryer. Air inlet 25 is covered with inlet screen 26.

The basic components of the hair dryer 20 are illustrated in an exploded perspective view in FIG. 3. The left enclosure half 34 is, for purposes of illustration, shown separated from the right enclosure half 35, exposing the main components located within. The basic construction configuration of the hair dryer 20 is that a rotor or impeller 36, oriented on a vertical axis A (embodying herein a rotor means for blowing such air in a hair drying stream), is located within the blower housing 21, and is driven by motor 37 housed within, and near (as shown), the bottom end 31 of handle 23, i.e., the handle housing portion. Left enclosure half 34 and right enclosure half 35 are so configured as to provide for a (upper) blower housing 21 portion and a (lower) handle 23 portion which are separated from each other by blower housing floor 40, embodying herein separation means for substantially separating such lower handle portion from such upper body portion. As noted, the blower housing 21 is generally circular in shape, excepting the projection of the discharge end 22, and is concentrically located about vertical axis A.

The top surface 24 of blower housing 21 is the air inlet 25, incorporating a multiplicity of inlet openings 41. The inlet openings 41, being large and numerous, allow incoming air flow 42 to enter the blower housing 21, directly at the impeller 36, and at a relatively low velocity, which reduces air movement noise (embodying herein an arrangement wherein such upper air inlet passage has at least as great a diameter as the diameter of a greatest sweep of such rotor means). The entire air inlet 25 is covered with a inlet screen 26, which is of a suitably small mesh to effectively prevent hair and other small debris from entering the blower housing 21. The inlet screen 26 is user-removable from the blower housing 21 to provide for cleaning as necessary, e.g., as by clips 28 which fit into slots 29 in well-known ways. The discharge air flow 43 exits the blower housing 21 at the discharge end 22 through the air-discharge outlet 33. Located within the discharge end 22 is a heating element module 44, through which the discharge air flow 43 passes, providing heat, as required, in a conventional manner.

The impeller 36 generally fills the interior of the blower housing 21 and provides air movement as further described with reference to FIGS. 4 and 5. Driving the impeller 36 is electric motor 37 (embodying herein the electric motor, adjacent such bottom of such housing, connected in driving relation with such rotor means), which is mounted to, and isolated from, the housing of the handle 23 of the hair dryer 20 with an insulating boot 45. The insulating boot 45 is made of a resilient rubber and provides suitably stable mounting for the motor 37 yet isolates motor produced noise and vibrations from transmission to the handle 23. The insulating boot 45 is secured to the interior of the handle 23 by the mating of its outward projections 46 interlocking with corresponding sockets or receptacles 47 within the interior of the handle 23. To complete the mechanical connection of the impeller 36 to the motor 37, as shown, the upward end 50 of an impeller (drive) shaft 51 (such shaft embodying herein a shaft means, having an upper and a lower end, for connecting such electric motor in driving relation with such rotor means) is secured to the central hub 52 of the impeller 36, and the lower end 53 is connected to the motor shaft 54 with a coupling 55. To stabilize radial motions of the impeller 36, the upward end 50 of the impeller shaft 51 is held in position with a bearing 56, embodying herein bearing means for holding such upper end of such shaft means in fixed relation to such housing. Bearing 56 is mounted into a bearing isolator 57, which, in turn, is secured to the blower housing floor 40 at opening 60. The bearing isolator 57 (embodying herein second resilient means for mounting such bearing means within such housing in such manner as to minimize sound and vibration in such housing) is made of a resilient rubber material for "soft-mounting" the bearing 56 for the impeller shaft 51 and for preventing vibrations and vibration noises of the impeller 36 from transferring to the blower housing 21.

The impeller 36 incorporates top fins 61 for moving the air from the air inlet 25 to the air-discharge outlet 33, and bottom fins 62 for drawing in a secondary air flow to cool the motor 37. This motor cooling air flow 63 enters through cooling inlet holes 64 in the bottom end 31 of the handle 23, up the exterior of the insulating boot 45 to vents 65 (embodying herein the arrangement wherein such motor boot comprises cooling means, including at least one transverse hole, for permitting cooling air from outside such motor boot to access such electric motor), which correspond with motor openings 66. After passing through and cooling the motor 37, the motor cooling air flow 63 continues up the interior of the handle 23, through holes 67 in the bearing isolator 57 (this arrangement embodying herein an arrangement wherein such bearing means and such second resilient means comprise a portion of such separation means) and to the bottom fins 62 of the impeller 36. After this motor cooling air flow 63 has been drawn into the blower housing 21, it combines with the air entering in through the air inlet 25 and exits the air-discharge outlet 33.

In addition to the physical separation of the impeller 36 in the blower housing 21 from the motor 37 within the handle 23 for vibration and noise control, an advantageous weight redistribution is gained. With the weight of the motor 37 contained in the handle 23, and removed from the blower housing 21, the operator will find this balanced arrangement less tiring than the conventional hair dryer which has its weighty components overhanging in the blower housing.

A cross-section plan view (through the section 4—4 of FIG. 1) of the blower housing 21, (air chamber) is shown in FIG. 4. Not shown, but directly above the impeller 36, and extending to approximately the same diameter or more as the impeller 36 is the air inlet 25 as shown in the other figures. The incoming air flow is directed straight downward to the top fins 61 of impeller 36, and the counter-clockwise rotation R of the impeller 36 forces the flow of air outward into a counter-clockwise movement around the periphery of the blower housing 21. This outward air flow exits the blower housing 21 at its discharge end 22, flowing out of the hair dryer in a hair-drying stream at air-discharge outlet 33.

A smooth, long sweeping transition 70 between the round shape of the blower housing 21 and the discharge end 22, on the left enclosure half 34, enhances unrestricted air flow. A more abrupt transition 71 between the round shape of the blower housing 21 and the discharge end 22 on the right enclosure half 35 improves air flow characteristics, which may also be enhanced with an optional baffle 72, shown in dotted lines. Shown by hidden lines under the impeller 36 are holes 67 of the bearing isolator 57 (illustrated in FIG. 3) which allow the motor cooling air flow to be drawn in by the rotation of fins 62 of impeller 36 and combined with the primary air flow.

The impeller 36, as shown, is of a radially-bladed, backward-curved, centrifugal design, with the top fins 61 (embodying herein an upper impeller portion comprising first impeller blades) and the bottom fins 62 (embodying herein a lower impeller portion comprising second impeller blades) being separated with a horizontal impeller floor 73 (embodying herein a disc-shaped portion separating such upper impeller portion from such lower impeller portion). The top fins 61 act as the primary air pump, whereas the bottom fins 62, on the underside of the impeller floor 73, act to pull air up through the handle 23. It is preferred that the diameter of the impeller 36 be greater than about 3 inches, considerably larger than in common hair dryers. This greater diameter allows a faster tip speed for a given motor speed. Also, the tip speed is effectively increased by the disclosed curved configuration (as shown) of the impeller blades such that, in operation, the top fins 61 do not work to equalize the air flow from an innermost portion of an impeller blade to an outermost portion of an impeller blade but rather allow the greatest air flow at the outermost areas of the impeller where the tip speed is fastest.

A cross-section side elevation view of the hair dryer 20 is illustrated in FIG. 5. Readily apparent is the large size of the air inlet 25 in relationship to the size of the blower housing 21. This large air inlet 25 (preferred to be at least as large in diameter as rotor or impeller 36) results in minimal velocity of the incoming air flow 42 as it enters into the blower housing 21 through the generously proportioned inlet openings 41 of the top surface 24 of the blower housing 21. Upon the incoming air flow 42 contact with the impeller 36, the direction of air flow is, in this embodiment, changed about 90 degrees as it exits the top fins 61 of the impeller 36 radially and enters the periphery of the blower housing 21. Additionally, a smaller proportion of air, the motor cooling air flow 63, enters through cooling inlet holes 64 on the bottom end 31 of the handle 23 for the purpose of cooling the motor 37. This motor cooling air flow 63 flows through the vents 65 of the motor insulating boot 45 and into the motor openings 66 to cool the motor 37. After passing through the motor 37, the motor cooling air flow 63 continues upward through the handle 23, through holes 67 of the bearing isolator 57 (mounted in housing floor 40), and to the adjacent bottom fins 62 of the impeller 36 (such arrangement embodying herein an arrangement wherein such lower impeller portion is adjacent and above such separation means, and wherein such hair dryer is constructed and arranged in such manner that, in operation, the relation between such disc-shaped portion and such separation means muffles sound and vibration in such hair dryer). The motor cooling air flow 63 is then directed outward from the impeller 36 air discharge outlet 33 portion of the blower housing 21. Thus, combined air flows exit the blower housing 21 through the discharge end 22, passing through the heating element module 44 and exiting the air-discharge outlet 33 as the discharge air flow 43. To prevent hair and other unwanted material from entering the blower housing 21, inlet screen 26 is fitted over the air inlet 25. Control of the air flow and air temperature is accomplished by controlling the motor 37 and heating element module 44 respectively, with air-flow and heater switches 27 (in typical ways) located in the upper portion of the handle 23, on the rear side, opposite the air-discharge outlet 33. A "coldshot" trigger 30 may be incorporated into the handle 23 to interrupt the electrical current to the heating element module 44 (in typical ways).

The construction of the impeller 36 is more clearly seen in partial cross-section. A cylindrical central hub 52 of the impeller 36 mounts the impeller 36 to the impeller shaft 51, which is an extension of the motor shaft 54. Integral with the central hub 52 is the impeller floor 73, a circular horizontal disc, extending outwardly perpendicular to the impeller shaft 51. Extending upwardly from the top side of the impeller floor 73 is the plurality of top fins 61. To the bottom side, extending downwardly. are the bottom fins 62. While the upward end of the impeller shaft 51, and in turn the impeller 36, is radially supported by bearing 56 and resilient bearing isolator 57, axial support is provided by connection to the motor 37, by way of coupling 55 as shown and described.

Figure 8:
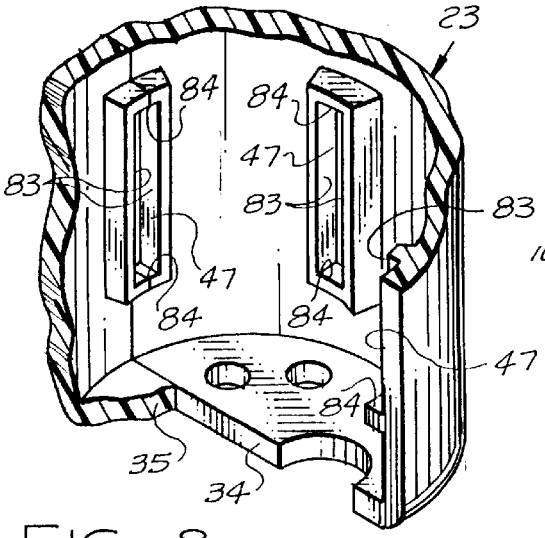
FIG. 8 is a perspective view of the motor mounting area of the handle.

The resilient mounting of the motor 37 to the interior of the handle 23 with the insulating boot 45 therefore provides the cushioned, axial support for the impeller 36. The torsional reaction force from the motor 37 and impeller 36 are resiliently restrained by the interlocking of the outward projections 46 of the insulating boot 45 with the handle 23, embodying herein mounting means, including multiple outward projections, for mounting such electric motor within such lower handle portion. Details of this interlocking are shown in FIGS. 7 and 8. With the combined vibration insulating of the impeller 36, impeller shaft 51, and motor 37, by the bearing isolator 57 and the insulating boot 45, all sound and vibration producing components are isolated from the housing of the hair dryer, i.e., the combined blower housing 21 and handle 23.

A cut-away perspective view of the bearing isolator 57, and its mounting, is illustrated in FIG. 6. The bearing isolator 57 incorporates an annular groove 74 around its periphery, which mates snugly with the round opening 60 in the blower housing floor 40. The bearing isolator 57 also includes an inward facing locking ring 75 projecting from its inward central bore 76. Bearing 56 contains an annular groove 77 on its exterior face which firmly engages with the locking ring 75 of the bearing isolator 57. This arrangement serves to tightly and accurately position the bearing 56 to the blower housing floor 40, yet provides cushioning and self alignment for the impeller shaft 51 which rotates within the bore 80 of the bearing 56.

A cross-section plan view through the handle 23 and the insulating boot 45 (embodying herein first resilient means for mounting such electric motor within such lower handle portion in such manner as to minimize sound and vibration in such handle portion) is shown in FIG. 7. The motor 37 is encased within the interior 81 of the insulating boot 45 which is concentrically located and retained within the interior of the handle 23. The insulating boot 45 is permanently secured to the motor 37 by a suitable mechanical bonding or adhesive to prevent rotation of the motor 37 from its torsional forces. The insulating boot 45 is keyed to the handle 23 with outward projections 46 which firmly engage mating sockets or receptacles 47 (embodying herein, on an inner surface of such lower handle portion, socket means, including multiple inward projections, for holding such motor boot) within the handle 23. As the outward projections 46 project from the outside diameter 82 of the insulating boot 45, there remains a gap 85 between the outside diameter 82 and the interior of the handle 23. This gap 85 provides a path for motor cooling air flow 63 as previously described, as well as routing for electrical wiring 38. This gap 85 also reduces the transmission of vibration from the motor 37 to the handle 23 and gap 85 embodies herein the gap means for providing substantial air space portions between such lower handle portion and such first resilient means (e.g., boot 45).

The receptacles 47 in the handle 23 for the outward projections 46 of the insulating boot 45 are illustrated in perspective in FIG. 8 The receptacles 47 are sockets formed by the longitudinal slots or spaces 83 within inwardly-extending projections 84, which project inward from the interior surface of the handle 23. These receptacles 47 are essentially sockets which surround and accurately position the outward projections 46 of the insulating boot 45. With this entrapment provided for the outward projections 46 of the insulating boot 45 and the motor 37 within, in addition to the cushioned mounting of the motor 37 and prevention from rotation, axial positioning of the motor 37 and the corresponding impeller 36 is provided. To facilitate installation of the motor 37 and insulating boot 45 assembly into the handle 23, two opposing receptacles 47 are located at the interface surfaces of the left enclosure half 34 and the right enclosure half 35.

Figure 9:
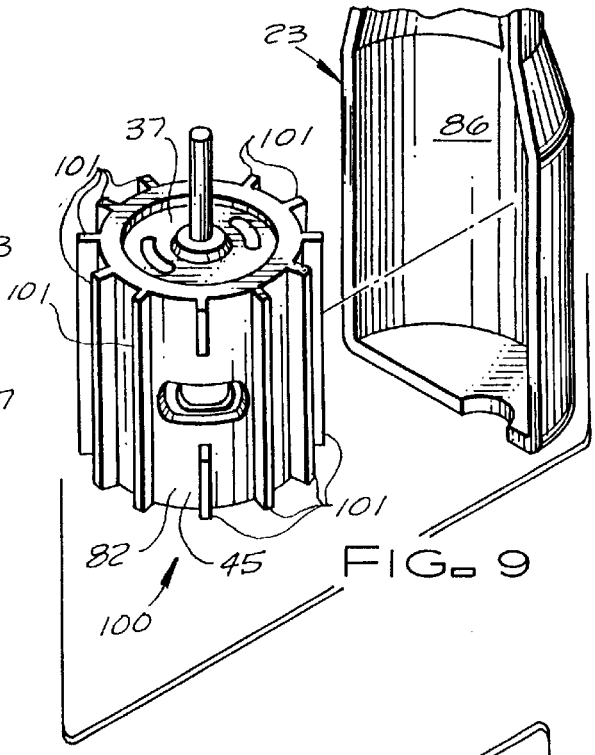
FIG. 9 is a perspective view of an alternate embodiment of the motor mounting.

Shown in FIG. 9 is a perspective view of a first alternate preferred embodiment 100 of the mounting of the motor 37. In lieu of the outward projections 46 (of the preferred embodiment of FIGS. 1–8) of insulating boot 45, the first alternate preferred embodiment incorporates a plurality of vertical ribs 101. Vertical ribs 101 extend and fan outwardly from the outside diameter 82 of the insulating boot 45, and continue longitudinally for its full length. The vertical ribs 101 are equally spaced, with their quantity and thickness established by the rigidity requirement of the motor mounting. The corresponding location of the interior 86 of the handle 23 remains smooth, without the need of female mounting counterparts (like sockets 47). A tight interference fit between the ribs 101 of the insulating boot 45 and the smooth interior 86 of the handle 23, in conjunction with the compressible material of the insulating boot 45, provide for a resilient yet stable mounting.

Figure 10:
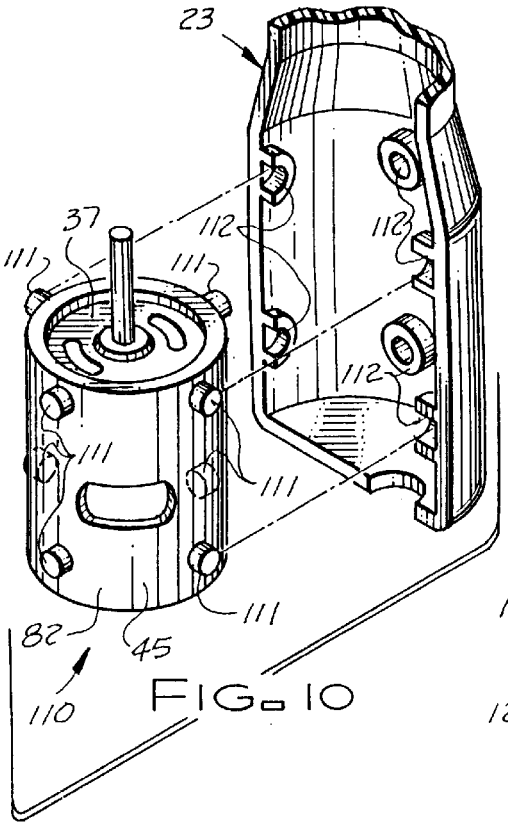
FIG. 10 is a perspective view of a second alternate embodiment of the motor mounting.

In FIG. 10 is a perspective view of second alternate preferred embodiment 110 of the mounting of the motor 37. This embodiment incorporates round male mounting protuberances 111, extending outwardly from the outside diameter 82 of the insulating boot 45. The mounting protuberances 111 (preferably 2 sets of 4, as shown) are located (as shown) near both the top end and the bottom end of the insulating boot 45 and positioned with each set of protuberances 111 having a 90 degree spacing between each protuberance 111. Mating female half sockets 112 are incorporated on each half of the handle 23, so that when the two handle 23 halves are assembled, each half socket 112 forms a full, round and complete female socket, respectively, for each mounting protuberance 111.

Figure 11:
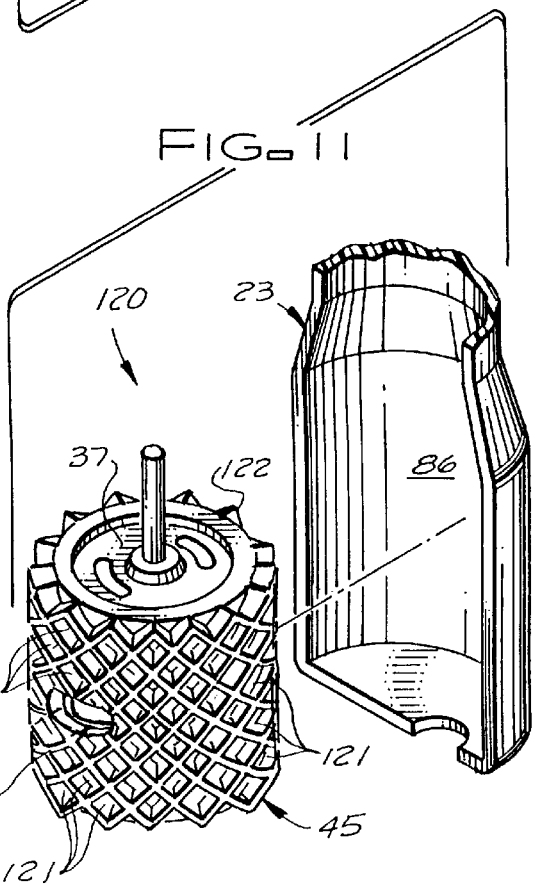
FIG. 11 is a perspective view of a third alternate embodiment of the motor mounting.

A third alternate preferred embodiment 120 of the mounting of the motor 37 is shown in a perspective view in FIG. 11. This method of construction of the insulating boot 45 incorporates a plurality of air cavities 121 within its structure by utilizing a honeycomb-like pattern 122. As with the first alternate embodiment 100 of FIG. 9, a handle 23 with a smooth interior 86 is suitable for mounting the insulating boot 45, relying on the compressibility of the material of the insulating boot 45 for permanent positioning.

Figure 12:
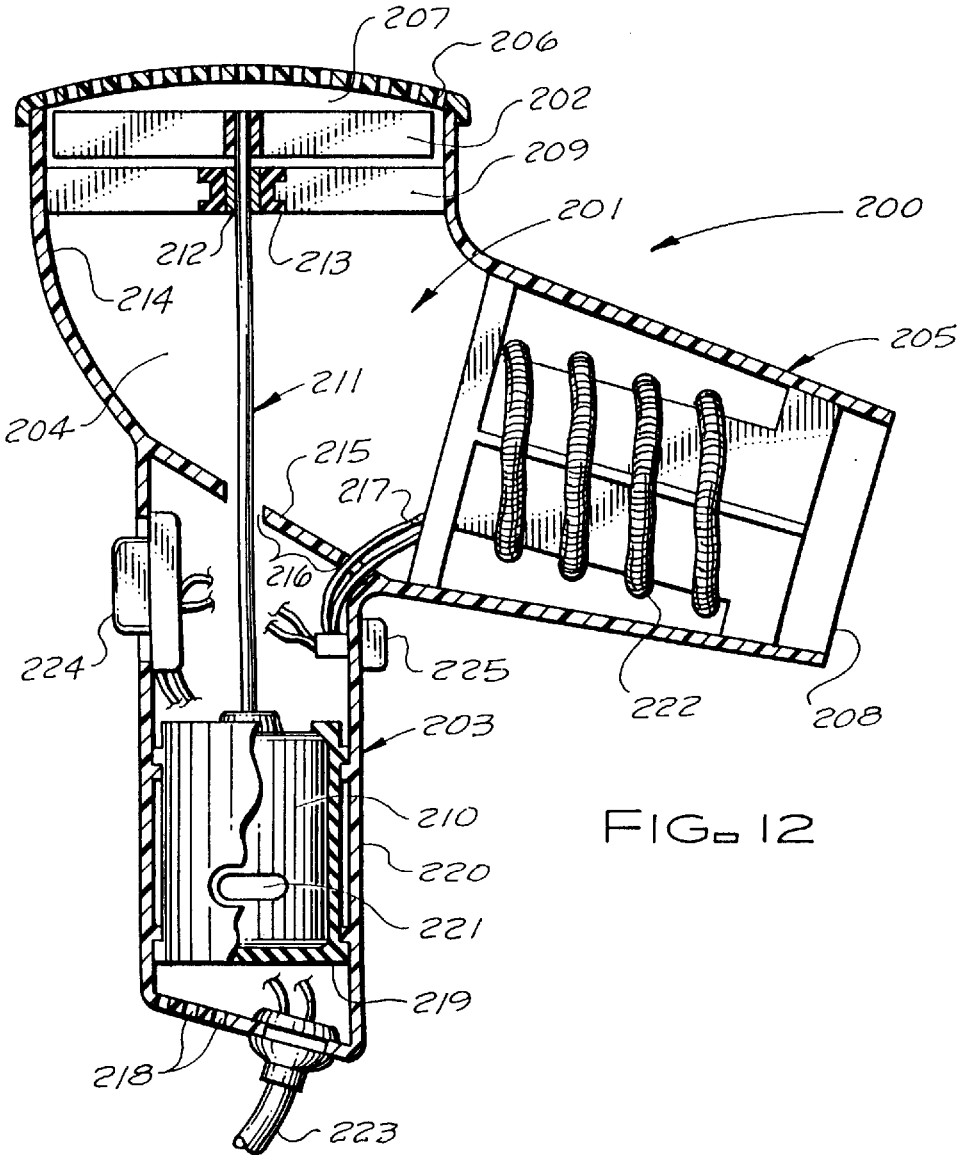
FIG. 12 is a cross-section side elevation view of an alternate embodiment of the quiet hand-held hair dryer.

Illustrated in FIG. 12 is a cross-section side elevation view of a preferred alternate embodiment 200 of the hand-held hair dryer of the present invention. This embodiment is similar to and incorporates many of the improvements and features of the preferred embodiment described in FIGS. 1–8, yet varies in overall configuration, mainly in the configuration of the air chamber 201 and the air-moving propeller 202. Only the variations from the described embodiment of FIG. 1 will be illustrated and discussed. The hair dryer 200 includes an elongated handle 203 with a circular air chamber portion 204 above the top of the handle 203 and an air outlet nozzle 205 projecting from the air chamber 204. In this embodiment, the nozzle 205 is angled at somewhat less than 90 degrees from the handle 203, preferably about 70 degrees. An angle perpendicular to the handle 203 would also be feasible. At the top of the air chamber 204 is a safety grill 206 which covers an air-admitting inlet 207. In this embodiment, the air-admitting inlet 207 protrudes above the plane of the nozzle 205 to form a crown-like rise above the air chamber 204. Alternatively, the inlet 207 may remain flush with the air chamber 204. Air flow passes through safety grill 206 to enter air chamber 204 through air-admitting inlet 207, and such air flow is ejected through an air-discharging outlet 208 at the end of the nozzle 205, during which transition the air flow changes direction by approximately one hundred and ten degrees. The degree of change in direction need not be such a precise figure for the hair dryer 200 to function well. The aesthetics of the configuration play a large role in determining the angle, as long as the air flow is not significantly compromised. Air is driven from the air-admitting inlet 207 to the air-discharging outlet 208 by a bladed rotor or propeller 202 positioned inside air chamber 204 and directly below air-admitting inlet 207. To increase performance, a stator 209 is positioned below the propeller 202 (when the handle 203 is held on a vertical axis).

To drive propeller 202, an electric motor 210 located in a bottom portion of the handle 203 is connected to the propeller 202 by a drive shaft 211. The drive shaft 211 is stabilized by a bearing 212, located within the stator 209 and surrounding the drive shaft 211. In a preferred embodiment, the bearing 212 is encased by an elastomeric resilient carrier which will be referred to as a bearing boot 213. Bearing boot 213 isolates the vibrational energy of the drive shaft 211 from the housing portions 214 to which the stator 209 is attached. While different arrangements for mounting the propeller 202 in the air chamber 204 may be used, along with other types of bearings, the preferred principle to be followed is to isolate the propeller energy from the housing of the hair dryer so noise and vibrations are not transmitted to the housing when the propeller 202 is spinning.

The handle 203 and the air chamber 204 are divided by a flooring 215 which directs the air flow out the air-discharging outlet 208. The flooring 215 is perforated by a set of holes 216 sufficient to allow the passage of a set of electrical wires 217, the shaft 211 and a flow of air for motor ventilation. Alternatively, air for cooling the motor 210 may flow through an enlarged opening for the impeller shaft or the electrical wires. Although variation in flooring designs are possible, what is preferred is that a flooring 215 guide the flow of air toward the air-discharging outlet 208, while allowing the enough passage and air flow into the handle for necessary electrical and mechanical functions. A plurality of holes 218 in the bottom of the handle 203 allows a small stream of air to flow from the air-admitting inlet 207 out through the base of the handle and thereby cool motor (in much the same manner as described for the FIG. 1 embodiment, but with down air flow instead of up). The motor 210 is encased in an elastomeric resilient rubber casing or motor boot 219 which locates the motor 210 and isolates the vibrational energy of the motor 210 from the handle portions 220 of the housing of the hair dryer 200. A plurality of holes in motor boot located to coincide with a set of motor cooling ducts 221 allow a flow of air to cool motor 210.

A resistance heater 222 positioned inside the nozzle 205 heats the air flow as it moves toward the air-discharging outlet 208. Power is supplied to the hand held hair dryer 200 through a conduit 223 extending from the handle 203 to an energy source. To operate the hair dryer 200, a switch 224 is provided near the top of handle 203, which controls the air and heat flow. An optional trigger 225 which interrupts the flow of current to the heater, known commonly a "cold shot" trigger, is positioned on the nozzle side of the upper portion of the handle 203, as shown.

From the above discussions and accompanying drawings, it can be seen that the improvements succeed in reducing hair dryer noise by using many novel features which each serve to lower noise levels. Because the motor no longer obstructs the air flow, and the impeller/propeller moves air faster than in conventional hair dryers for a given motor speed, the motor can run at a lower RPM to achieve the same air flow. A typical motor speed for the described embodiment of FIG. 1, for example, would be about 6,000–8,000 revolutions per minute, about ⅓ to ½ of typical motor speeds for other typical hair dryers. Because a motor boot is used, as shown herein, noise from the motor is dampened. Because the motor boot is mounted so that there is a space between the motor and the housing, the vibration of the motor is further isolated from the housing. Because the bearing which supports the impeller/propeller is encased in a bearing boot, as shown herein, the vibration of the impeller and the impeller shaft is isolated from the housing. And because the air inlet size is roughly double the usual size, the air passes through the grating more slowly and therefore makes less noise while passing. Each of these improvements alone reduces the noise of a hair dryer, and combined they create a hair dryer which is typically half as loud as most existing hand-held hair dryers moving the same volume of air.

Furthermore, in using the present invention, it has been found that, in addition to lowering the noise level, the entire noise spectrum was shifted toward the lower-frequency end, so that the invention is characterized not only by an objective but also by a subjective improvement in the noise characteristics of a hair dryer. In addition, with the motor in the base of the handle, the dryer is balanced when grasped by an operator in the central part of the handle, as the center of gravity of the dryer is near the motor. Thus, it is seen that the improvements in this invention yield a quieter hair dryer with better noise characteristics and a more ergonomic design.

Although applicant has described applicant's preferred embodiments of this invention, it will be understood that the broadest scope of this invention includes such modifications as diverse shapes and sizes and materials. Such scope is limited only by the below claims as read in connection with the above specification.

What is claimed is:

1. In a quiet hand-held hair dryer, the combination comprising:

a. a housing having a lower handle portion and an upper body portion forming upper air inlet and air outlet passages for passing air into said housing and for discharging said air in a hair drying stream, said housing having a top and a bottom;

b. air inlet means at said top of said housing, for supplying air to said hair dryer;

c. immediately beneath said air inlet means, rotor means for blowing said air in a hair drying stream;

d. an electric motor, adjacent said bottom of said housing, connected in driving relation with said rotor means;

e. shaft means, having an upper and a lower end, for connecting said electric motor in driving relation with said rotor means; and f. first resilient means, encircling said motor and affixed to said handle portion, for minimizing sound and vibration in said handle portion from said motor.

2. A hair dryer according to claim 1, further comprising:

a. separation means for substantially separating said lower handle portion from said upper body portion.

3. A hair dryer according to claim 2, further comprising:

a. gap means for providing substantial air space portions between said lower handle portion and said first resilient means.

4. A hair dryer according to claim 2, further comprising:

a. bearing means for holding said upper end of said shaft means in fixed relation to said housing; and b. second resilient means, encircling said bearing means and affixed to said housing, for minimizing sound and vibration in said housing.

5. A hair dryer according to claim 2 wherein said rotor means comprises a rotor comprising:

a. an upper impeller portion comprising first impeller blades;

b. a lower impeller portion comprising second impeller blades; and c. a disc-shaped portion separating said upper impeller portion from said lower impeller portion;

d. wherein said hair dryer is structured and arranged to pull air up through said lower handle portion to cool said electric motor.

6. A hair dryer according to claim 2 further comprising:

a. air outlet means, at a side of said housing, for directing said hair drying stream in a direction substantially perpendicular to the direction of flow of said air in said air inlet passage for passing air into said housing;

b. wherein said separation means comprises a lower portion of said passages.

7. A hair dryer according to claim 6 wherein said rotor means comprises a rotor comprising:

a. an upper impeller portion comprising first impeller blades;

b. a lower impeller portion comprising second impeller blades; and c. a disc-shaped portion separating said upper impeller portion from said lower impeller portion;

d. wherein said hair dryer is structured and arranged to pull air up through said lower handle portion to cool said electric motor.

8. A hair dryer according to claim 7 wherein said lower impeller portion is adjacent and above said separation means, and wherein said hair dryer is constructed and arranged in such manner that, in operation, the relation between said disc-shaped portion and said separation means muffles sound and vibration in said hair dryer.

9. A hair dryer according to claim 2 wherein a said upper air inlet passage has at least as great a diameter as the diameter of a greatest sweep of said rotor means.

10. A hair dryer according to claim 9 wherein said rotor means has a diameter of at least about 3 inches.

11. A hair dryer according to claim 2, further comprising:

a. bearing means for holding said upper end of said shaft means in fixed relation to said housing; and b. second resilient means, encircling said bearing means and affixed to said housing, for minimizing sound and vibration in said housing.

12. A hair dryer according to claim 11 wherein said bearing means and said second resilient means comprise a portion of said separation means.

13. In a quiet hand-held hair dryer, the combination comprising:

a. a housing having a lower handle portion and an upper body portion forming upper air inlet and air outlet passages for passing air into said housing and for discharging said air in a hair drying stream, said housing having a top and a bottom;

b. air inlet means at said top of said housing, for supplying air to said hair dryer;

c. immediately beneath said air inlet means, rotor means for blowing said air in a hair drying stream;

d. an electric motor, adjacent said bottom of said housing, connected in driving relation with said rotor means;

e. shaft means, having an upper and a lower end, for connecting said electric motor in driving relation with said rotor means;

f. separation means for substantially separating said lower handle portion from said upper body portion; and g. first resilient means, encircling said motor and affixed to said handle portion, for minimizing sound and vibration in said handle portion from said motor;

h. wherein said first resilient means comprises a resilient rubber-like cylindrical motor boot having an outer surface comprising mounting means, including multiple outward projections, for mounting said electric motor within said lower handle portion.

14. A hair dryer according to claim 13 wherein said first resilient means further comprises:

a. on an inner surface of said lower handle portion, socket means, including multiple inward projections, for holding said motor boot.

15. In a quiet hand-held hair dryer, the combination comprising:

a. a housing having a lower handle portion and an upper body portion forming upper air inlet and air outlet passages for passing air into said housing and for discharging said air in a hair drying stream, said housing having a top and a bottom;

b. separation means for substantially separating said lower handle portion from said upper body portion;

c. air inlet means, at said top of said housing, for supplying air to said hair dryer;

d. air outlet means, at a side of said housing, for directing said hair drying stream in a direction substantially perpendicular to the direction of flow of said air in said air inlet passage for passing air into said housing;

e. immediately beneath said air inlet means, rotor means for blowing said air in a hair drying stream;

f. heating means, in said air outlet passage, for heating said air;

g. an electric motor, adjacent said bottom of said housing, connected in driving relation with said rotor means; and h. shaft means, having an upper and a lower end, for connecting said electric motor in driving relation with said rotor means;

I. first resilient means, encircling said motor and affixed to said handle portion, for minimizing sound and vibration in said handle portion from said motor;

j. bearing means for holding said upper end of said shaft means in fixed relation to said housing; and k. second resilient means, encircling said bearing means and affixed to said housing, for minimizing sound and vibration in said housing;

l. wherein a said upper air inlet passage has at least as great a diameter as the diameter of a greatest sweep of said rotor means.

16. A hair dryer according to claim 15 wherein said separation means comprises a lower portion of said passages.

17. A hair dryer according to claim 16 wherein said rotor means comprises a rotor comprising:

a. an upper impeller portion comprising first impeller blades constructed and arranged to blow air from said air inlet passage to said air outlet passage;

b. a lower impeller portion comprising second impeller blades constructed and arranged to blow air from said lower handle portion to said air outlet passage; and c. a disc-shaped portion separating said upper impeller portion from said lower impeller portion;

d. wherein said hair dryer portion is structured and arranged to pull air up through said lower handle portion to cool said electric motor.

18. A hair dryer according to claim 17 wherein said lower impeller portion is adjacent and above said separation means, and wherein said hair dryer is constructed and arranged in such manner that, in operation, the relation between said disc-shaped portion and said separation means muffles sound and vibration in said hair dryer.

19. A hair dryer according to claim 18 wherein said bearing means and said second resilient means comprise a portion of said separation means.

20. In a quiet hand-held hair dryer, the combination comprising:

a. a housing having a lower handle portion and an upper body portion forming upper air inlet and air outlet passages for passing air into said housing and for discharging said air in a hair drying stream, said housing having a top and a bottom;

b. separation means for substantially separating said lower handle portion from said upper body portion;

c. air inlet means, at said top of said housing, for supplying air to said hair dryer;

d. air outlet means, at a side of said housing, for directing said hair drying stream in a direction substantially perpendicular to the direction of flow of said air in said air inlet passage for passing air into said housing;

e. immediately beneath said air inlet means, rotor means for blowing said air in a hair drying stream;

f. heating means, in said air outlet passage, for heating said air;

g. an electric motor, adjacent said bottom of said housing, connected in driving relation with said rotor means;

h. shaft means, having an upper and a lower end, for connecting said electric motor in driving relation with said rotor means;

i. first resilient means, encircling said motor and affixed to said handle portion, for minimizing sound and vibration in said handle portion from said motor;

j. bearing means for holding said upper end of said shaft means in fixed relation to said housing; and k. second resilient means, encircling said bearing means and affixed to said housing, for minimizing sound and vibration in said housing;

l. wherein a said upper air inlet passage has at least as great a diameter as the diameter of a greatest sweep of said rotor means; and m. wherein said first resilient means comprises a resilient rubber-like cylindrical motor boot having an outer surface comprising mounting means, including multiple outward projections, for mounting said electric motor within said lower handle portion.

21. A hair dryer according to claim 20 wherein said first resilient means further comprises:

a. on an inner surface of said lower handle portion, socket means, including multiple inward projections, for holding said motor boot.

22. A hair dryer according to claim 20 wherein said motor boot comprises cooling means, including at least one transverse hole, for permitting cooling air from outside said motor boot to access said electric motor.

* * * * *